US005842298A

United States Patent [19]

Gephart et al.

[11] Patent Number: 5,842,298

[45] Date of Patent: Dec. 1, 1998

[54] ARCHED MIRROR FRAME FOR RECTANGULAR MIRRORS

[75] Inventors: John D. Gephart, Rocky Hill; William J. Plein, II, South Windsor, both of Conn.

[73] Assignee: The Stanley Works, New Britain, Conn.

[21] Appl. No.: 893,807

[22] Filed: Jul. 11, 1997

[51] Int. Cl.[6] ..... G09F 1/12

[52] U.S. Cl. ..... 40/773; 40/768

[58] Field of Search ..... 40/739, 741, 768, 40/790, 791; 52/785.1, 204.59, 656.6, 204.62

[56] References Cited

U.S. PATENT DOCUMENTS

| | | | |
|---|---|---|---|
| 1,225,195 | 5/1917 | Wanda | 40/790 |
| 1,496,581 | 6/1924 | Kusterle | 52/785.1 |
| 1,652,678 | 12/1927 | Nathanson | 52/785.1 |
| 1,812,403 | 6/1931 | Hammer | 40/791 |
| 1,956,173 | 4/1934 | Katzman | 52/785.1 |
| 2,177,405 | 10/1939 | Gross | 40/768 |
| 2,668,032 | 2/1954 | Haefner | 52/785.1 |
| 5,042,180 | 8/1991 | Horiuchi | 40/791 |
| 5,568,713 | 10/1996 | Gagne et al. | 52/784.1 |

FOREIGN PATENT DOCUMENTS

| | | | |
|---|---|---|---|
| 2209182 | 5/1989 | United Kingdom | 52/204.59 |

*Primary Examiner*—Brian K. Green
*Assistant Examiner*—Marcus Dolce
*Attorney, Agent, or Firm*—Pepe & Hazard LLP

[57] ABSTRACT

An synthetic resin frame for displaying a rectangular element has an arcuately contoured portion and a cross section providing an outer peripheral wall, an intermediate body portion and an inner peripheral wall extending substantially parallel to the outer peripheral wall and circumscribing an enclosure with an arcuately contoured peripheral portion. The base surface of the inner peripheral wall is disposed in a first plane spaced above a second plane defined by the base surface of the outer peripheral wall, and ribs on the body portion are spaced about the periphery of the frame with their base surfaces disposed in a third plane intermediate the first and second planes. These ribs define a rectangular enclosure spaced outwardly of the arcuately contoured enclosure and in which the rectangular element is seated.

8 Claims, 4 Drawing Sheets

ARCHED MIRROR FRAME FOR RECTANGULAR MIRRORS

BACKGROUND OF THE INVENTION

The present invention related to wall mirrors and the like, and more particularly, to a novel integrally molded frame with an arcuate contour in which mirrors and the like may be mounted.

Wall mirrors and other wall decorations such as photographs, paintings and the like frequently employ frames with arcuate contours including circles, ovals, arches and the like. Generally, the mirror or other object which is being displayed in the accurately contoured frame has a peripheral contour which approximates that of the frame itself. As a result, arcuately contoured frames have usually been limited to the display of articles which have a complementary contour or they have required the cutting of the articles to approximate the contour of the frame in which the article is to be mounted.

In the instance of wall mirrors which are intended to be sold at relatively low cost, the added cost of the cutting operation for the mirror can be relatively substantial and the cost of producing a frame to seat such contoured articles can be substantially increased.

Accordingly, it is an object of the present invention to provide a novel arcuately contoured frame which will seat and display articles having a rectangular configuration.

It is also an object to provide such a frame which can be readily and economically fabricated and in which the displayed article may be readily and securely mounted.

Another object is to provide a wall mounted mirror assembly using such a frame in which a rectangular mirror is firmly mounted and attractively displayed.

SUMMARY OF THE INVENTION

An integrally formed synthetic resin frame for displaying a rectangular element has an arcuately contoured portion about its periphery. The frame cross section provides an outer peripheral wall, an intermediate body portion and an inner peripheral wall extending substantially parallel to the outer peripheral wall and circumscribing an enclosure with an arcuately contoured peripheral portion adapted to seat the rectangular element for viewing in the enclosure.

The base surface of the inner peripheral wall is disposed in a first plane spaced above a second plane defined by the base surface of the outer peripheral wall. Ribs on the body portion are spaced about the periphery of the frame and have their base surfaces disposed in a third plane intermediate the first and second planes. These ribs define a rectangular enclosure spaced outwardly of the arcuately contoured enclosure and in which the rectangular element may be seated.

Preferably, the body portion includes a multiplicity of steps extending upwardly from the outer peripheral wall and a descending section terminating at the inner peripheral wall, and the ribs are disposed in the descending section. The descending section provides a sloping, substantially planar outer surface. Most usually, the contour of the frame is provided by generally rectilinear base and side portions and an arched top portion.

In the framed display, the planar displayed element of generally rectangular configuration is disposed in the rectangular enclosure defined in the ribs. Suitable means secures the displayed element in the frame with its surface abutting the lower surface of the inner peripheral wall and its margins disposed adjacent the inner surface of the ribs. The securing means generally includes a flexible adhesive securing the element to the ribs.

In addition, the assembly may include a generally planar backing member extending across the frame and abutting the lower surface of the ribs. The backing member has its margins adjacent the inner surface of the outer peripheral wall, and there is also included means securing the backing member to the outer peripheral wall of the frame. Resilient spacing means may be provided between the displayed element and the backing member.

DETAILED DESCRIPTION OF THE ILLUSTRATED EMBODIMENT

Figure 1:
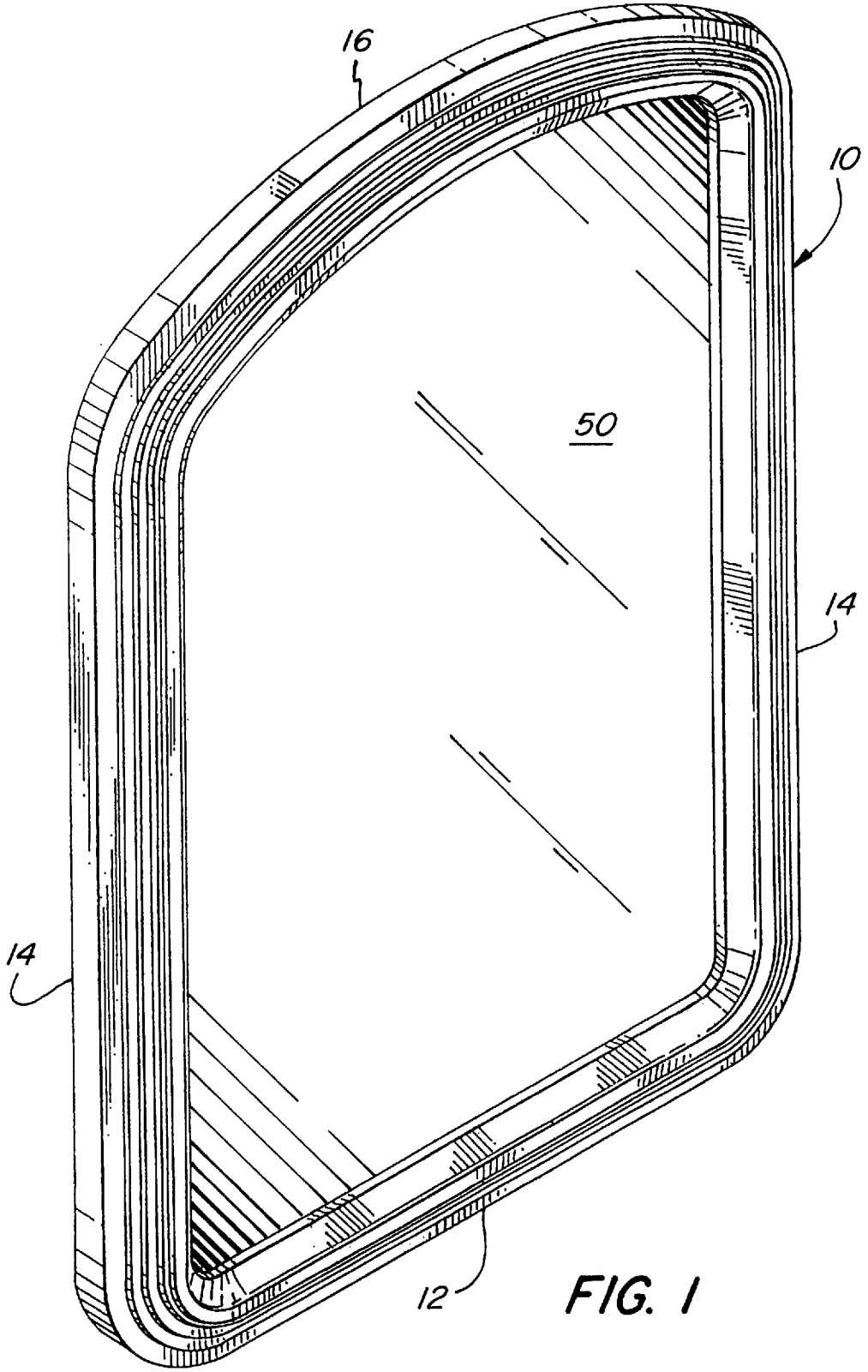
FIG. 1 is a perspective view of a wall mirror embodying the present invention.
Figure 3:
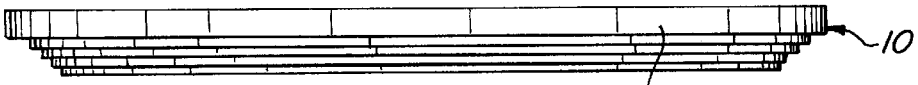
FIG. 3 is a top view thereof.
Figure 2:
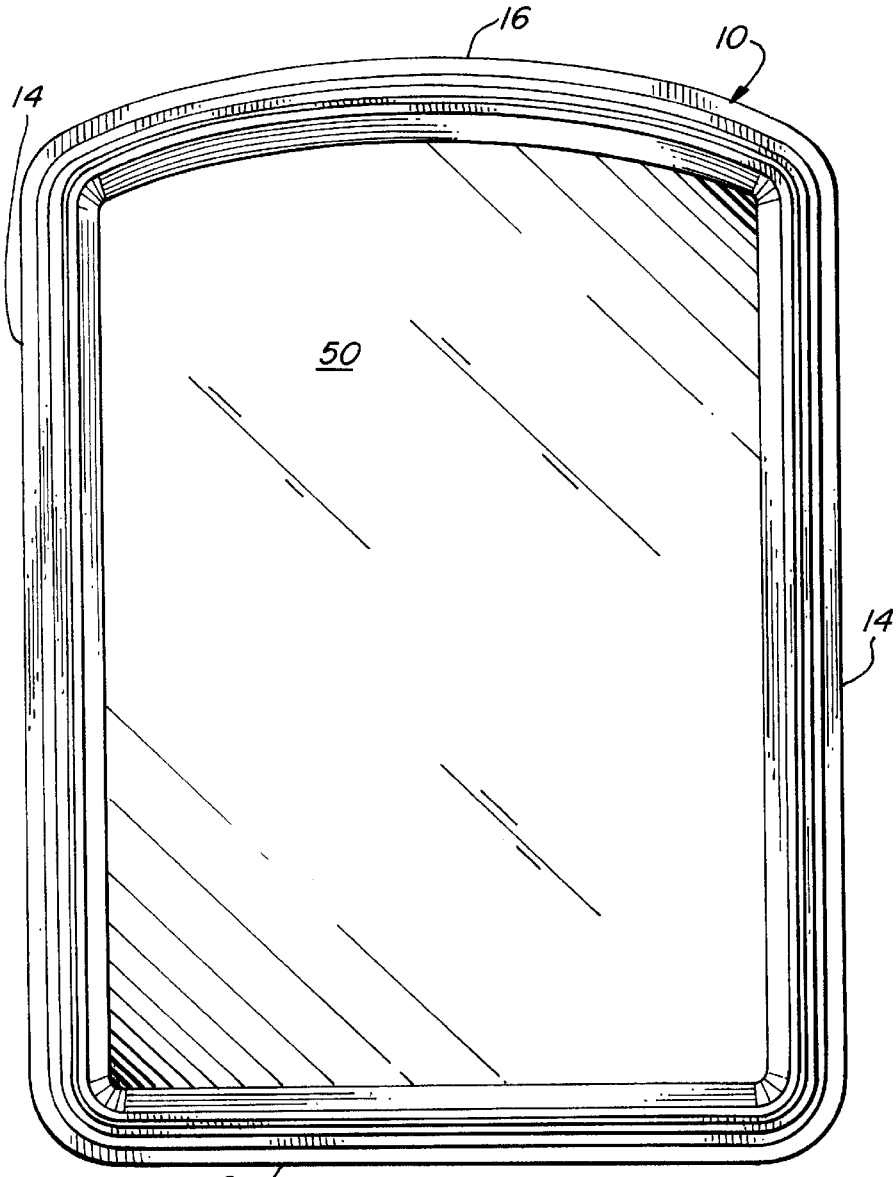
FIG. 2 is a front elevational view thereof.
Figure 5:
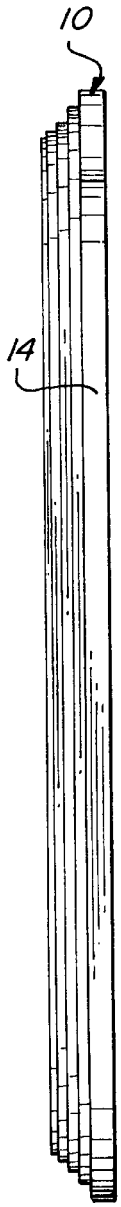
FIG. 5 is a side elevational view thereof.
Figure 4:
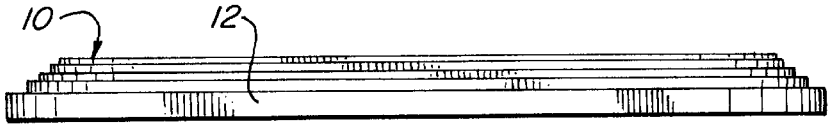
FIG. 4 is a bottom view thereof.

As seen in FIGS. 1–7, a wall mirror embodying the present invention includes a frame generally designated by the numeral 10 which is integrally formed from synthetic resin and in which is seated a mirror generally designated by the numeral 50.

The frame 10 is integrally formed from synthetic resin and its peripheral contour is defined by a relatively rectilinear bottom portion 12 and side portions 14 and a convexly arcuate or arched top portion 16.

Figure 6:
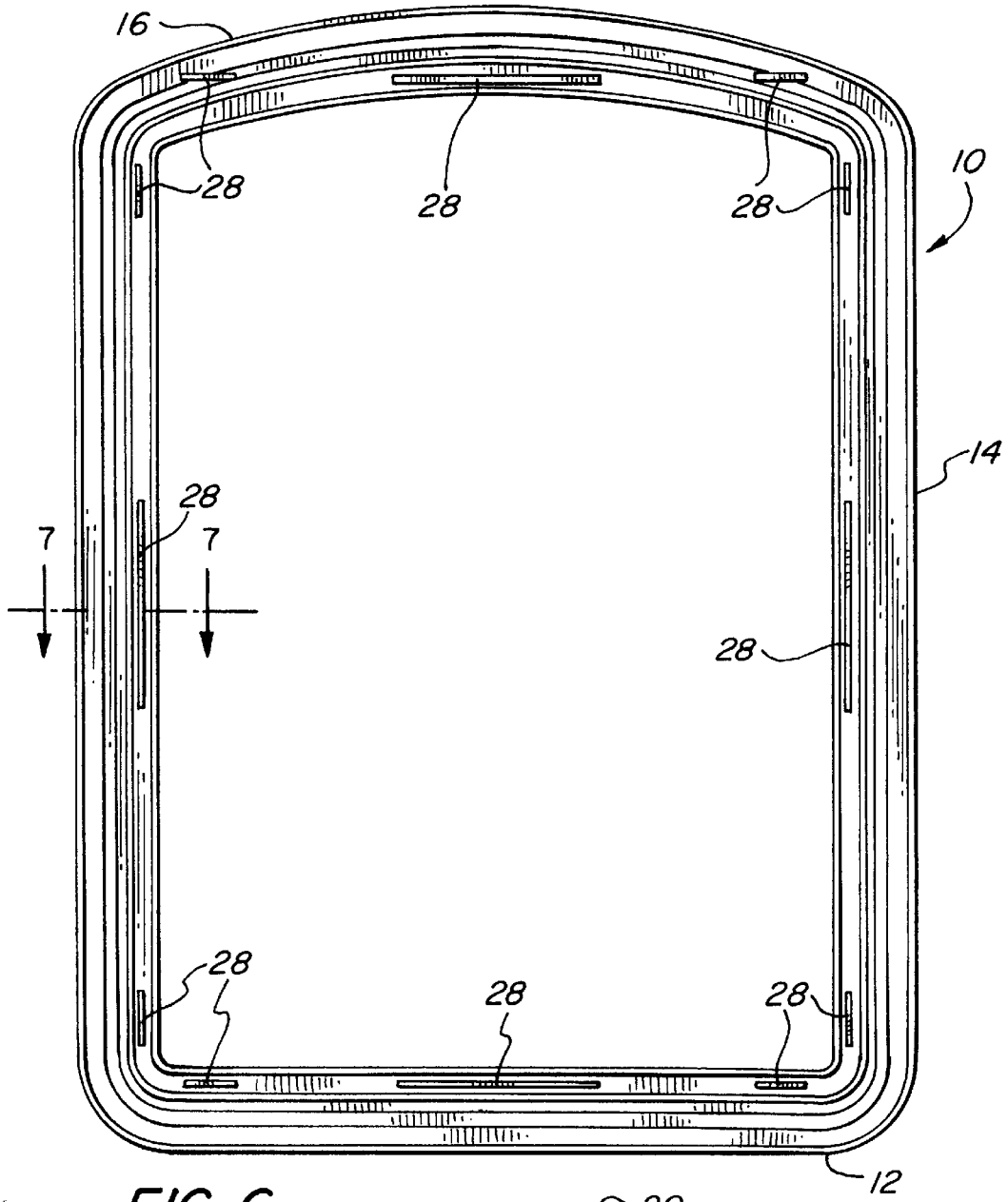
FIG. 6 is a rear elevational view thereof with the mirror removed.

As best seen in FIG. 6, the frame 10 has a cross section defined by a rectilinear outer peripheral wall 18, a central body 20, and a short rectilinear inner peripheral wall 22 which parallels the outer peripheral wall 18 to define an enclosure with an arcuately contoured peripheral portion. The body 20 is comprised of a series of ascending step portions 24 and a descending sloped portion 26 from the highest step 24 which extends to the inner peripheral wall 22. On the rear or inner surface of the sloped portion 26 at spaced intervals about the frame 10 are a series of depending rectilinear ribs 28. As best seen in FIG. 6, these ribs 30 define a rectangular enclosure outwardly of the arcuately contoured enclosure defined by the inner peripheral wall 22.

Figure 7:
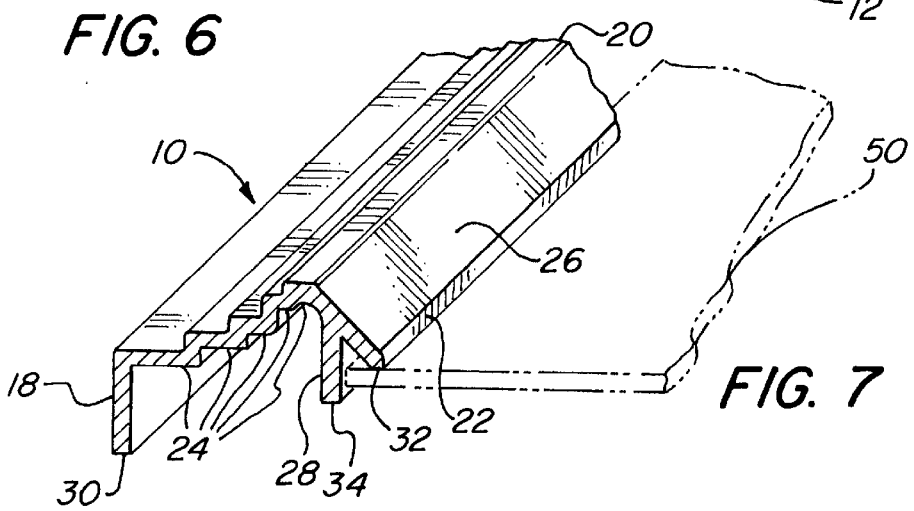
FIG. 7 is a fragmentary sectional view thereof along the line 7—7 of FIG. 6 drawn to an enlarged scale and fragmentarily showing the mirror in phantom line.

As seen in FIG. 7, the base or edge surface 30 of the outer peripheral wall 18 lies in a plane which is substantially below that of the plane in which the base or edge surface 32 of the inner peripheral wall 22 lies. The base or edge surface 34 of the ribs 28 lies in a plane which is intermediate the planes defined by the base surfaces 30, 32.

Figure 8:
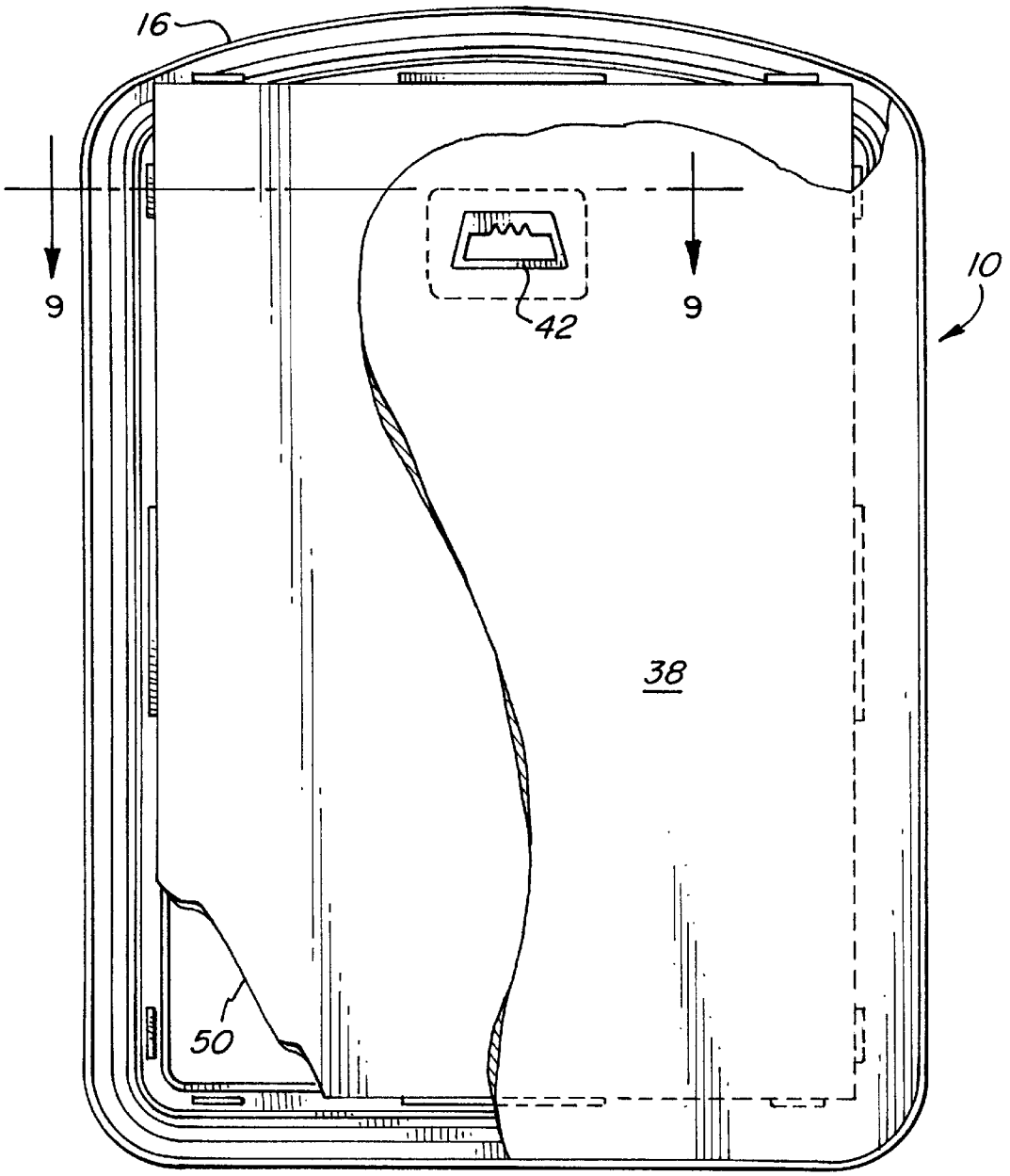
FIG. 8 is a rear elevational view thereof with the mirror and backing fragmentarily illustrated.
Figure 9:
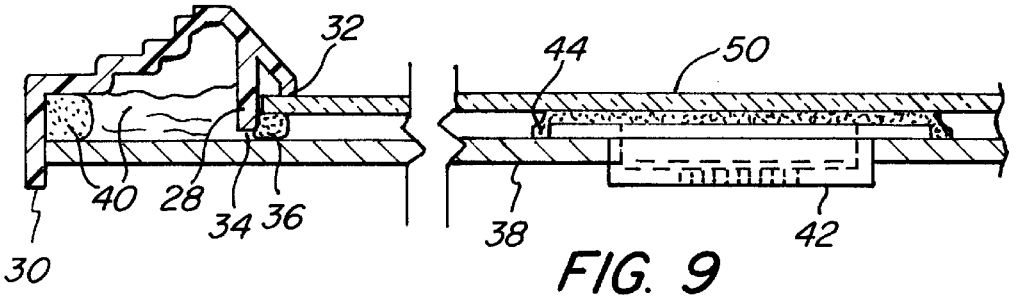
FIG. 9 is a fragmentary sectional view thereof along the line 9—9 of FIG. 8 and drawn to an enlarged scale.

Turning next to FIGS. 7–9, the mirror 50 is of rectangular configuration, and it is dimensioned to fit fairly snugly between the inner side surfaces of the ribs 28 and it is secured thereto by flexible adhesive 36. The spacing of the ribs 28 from the inner peripheral wall 22 allows the rectangular mirror to extend beyond the margins of the arcuate contour of the enclosure at the top portion 16 of the frame 10 and a viewer will not normally sense that the mirror is not complimentarily arcuately contoured. The mirror sits tightly against the base or surface edge 32 of the inner peripheral wall 22 so that it is firmly supported.

As seen in FIGS. 8–9, it is customary to apply a backing member 38 such as cardboard, chipboard or the like which extends across the opening in which the mirror 50 is seated and over the ribs 28 so as to abut the inner surface of the outer peripheral wall 18 as shown in FIG. 9. This backing member 38 is bonded to the peripheral wall 18 of the frame 10 by adhesive 40 which is desirably the same as the flexible adhesive 36.

In this embodiment, the backing member 38 is provided with an aperture centrally of its upper portion in which is seated a mounting member 42 which is secured to the backing member by a flexible adhesive 44 which may also serve to provide resilient cushioning for the mirror 50.

As can be readily appreciated, the frame of the present invention is readily molded from synthetic resin such as polystyrene, acrylonitrile/butadiene/styrene terpolymers, polyurethane, polyvinyl chloride and the like which provide the desired degree of rigidity and structural strength. The molding process may be injection molding or compression molding depending upon the resin selected.

The contours for the frame may vary from the single arch shown in the appended drawings to one in which both the top and bottom portions are arched. Alternatively, the frame may have arched portions disposed along both sides or an oval configuration although this may require an increase in width of the frame cross section. The frame also may have a circular or oval configuration.

The placement of the ribs should be such that the edges of the rectangular mirror or other object being displayed will not be viewable because the margins are disposed outwardly of the inner periphery of the frame. In the illustrated embodiment, the ribs are discontinuous and spaced at convenient distances to ensure adequate and firm support for the periphery of the mirror. However, the rib may also extend continuously about the mirror frame although this requires more material and cost.

The backing member may be fabricated from various materials including corrugated board, synthetic resin foam, honeycomb material and the like. The material may be resiliently deflectable and, if adhesive or other spacing means is provided between it and the mirror, it desirably has good damping characteristics so that it may absorb both impact forces on the mirror and vibrations which might be induced in the mirror.

The several elements of the assembly are assembled by use of adhesive. The face of the mirror is seated against the bottom edge of the inner peripheral wall and its margins are located closely adjacent the side of the ribs. It is secured in place by beads of a flexible adhesive compound at each of the ribs.

The backing member is then placed over the mirror and its face seats against the bottom edge of the ribs and its margins are seated closely adjacent the outer peripheral wall. The flexible adhesive is applied about its margins to bond it to the outer peripheral wall; The adhesive can be provided as a continuous bead or as spaced beads about the periphery.

Although various types of adhesives may be utilized to effect the bonding of the mirror to the frame, it is preferable to use a high solids, hot melt adhesive. A flexible pressure-sensitive hot melt adhesive sold by National Starch and Chemical Company under the designation INSTAWELD 34-3260 has been found highly effective. The mirror is seated in the frame and beads of adhesive are easily applied to the inner wall surface of the ribs and the back of the mirror. The adhesive is easily applied by a pressurized nozzle and the adhesive quickly provides a high strength bond. The backing member is then similarly mounted.

In the illustrated embodiment, a bead of adhesive is also provided between the mirror and the backing member. Use of flexible adhesive spacing beads will not only increase the strength of the assembly, but also provide damping and limited impact absorption.

Thus, it can be seen from the foregoing detailed specification and claims that the arcuately contoured frame of the present invention is one which may be fabricated readily to provide an attractive assembly in which a rectangular mirror is firmly supported and attractively displayed. The configuration of the frame may be varied and the mirror easily assembled therein. By enabling mounting of rectangular elements, the cost of the frame and the assembly is reduced.

Having thus described the invention, what is claimed is:

1. A framed display including:

(a) a planar displayed element of rectangular configuration;

(b) an integrally formed synthetic resin frame with an arcuately contoured portion seating said element for display therewithin, said frame having a cross section providing (i) an outer peripheral wall, (ii) an intermediate body portion and (iii) an inner peripheral wall extending substantially parallel to said outer peripheral wall and circumscribing an enclosure with an arcuately contoured peripheral portion in which said displayed element is viewed, a base surface of said inner peripheral wall being disposed in a first plane spaced above a second plane defined by a base surface of said outer peripheral wall, said frame including depending ribs on an inner surface of said body portion spaced about the periphery of said frame and said ribs having their base surface disposed in a third plane intermediate said first and second planes, said ribs defining a rectangular enclosure spaced outwardly of said enclosure with said arcuately contoured peripheral portion; and (c) means securing said displayed element in said frame with an outer surface of said displayed element abutting the base surface of said inner peripheral wall and with the periphery of said displayed element being disposed adjacent the inner surface of said ribs.

2. The framed display in accordance with claim 1 wherein said securing means includes a flexible adhesive securing said element to said ribs.

3. The framed display in accordance with claim 1 wherein there is included a generally planar backing member extending across said frame and abutting the lower surface of said ribs, said backing member having its periphery disposed adjacent the inner surface of said outer peripheral wall, and means securing said backing member to said outer peripheral wall of said frame.

4. The framed display in accordance with claim 3 wherein there is included a flexible adhesive between said displayed element and said backing member.

5. The framed display in accordance with claim 1 wherein said body portion includes a multiplicity of steps extending upwardly from said outer peripheral wall and a descending section terminating at said inner peripheral wall.

6. The framed display in accordance with claim 5 wherein said ribs are disposed in said descending section.

7. The framed display in accordance with claim 5 wherein said descending section provides a sloping, substantially planar outer surface.

8. The framed display in accordance with claim 1 wherein a contour of said frame is provided by generally rectilinear base and side portions and an arched top portion.

* * * * *